US005741011A

United States Patent [19]

So et al.

[11] Patent Number: 5,741,011

[45] Date of Patent: Apr. 21, 1998

[54] METHOD OF PLAYING A GAME OF SKILL AND CHANCE

[75] Inventors: Bryan So, Torrance; Stephen A. Miller, Rolling Hills Estates; Allan L. Nelson, Torrance, all of Calif.

[73] Assignee: Normandie Casino, Gardena, Calif.

[21] Appl. No.: 810,804

[22] Filed: Mar. 6, 1997

[51] Int. Cl.[6] ..... A63F 1/00

[52] U.S. Cl. ..... 273/292; 273/303; 273/304

[58] Field of Search ..... 273/292, 274, 273/303–306

[56] References Cited

U.S. PATENT DOCUMENTS 5,397,128 3/1995 Hesse et al. ..... 273/292

OTHER PUBLICATIONS

"21st Century Blackjack", Casino Gaming Concepts, Inc., Oct. 1995.

"California Baccarat", Casino Gaming Concepts, Inc., Oct. 1995.

*Primary Examiner*—Benjamin H. Layno

*Attorney, Agent, or Firm*—Bruce A. Jagger

[57] ABSTRACT

A game of skill and chance in which a plurality of decks of 34 cards comprising 10 numeric pairs of yellow designed cards, 10-10 through 1-1, and 7 numeric pairs of blue designed cards, 7-7 through 1-1, is used. One card in the deck is designated a wild card. Two cards are given special significance when present as a pair. This pair is the highest ranking hand. The next highest ranking hand is a yellow pair of 10s followed by yellow pairs of 9s through 1s, blue pairs of 7s through 1s, and then numeric combinations of any color. The highest permitted numeric combination is 9. Each player is dealt a set of 2 cards with the option of receiving one additional card. Any hand containing 3 cards can not be valued as a pair, that is, it will always be a numeric combination. The hand of each player is compared, in turn, to the corresponding hands of a banker/player.

7 Claims, 2 Drawing Sheets

METHOD OF PLAYING A GAME OF SKILL AND CHANCE

BACKGROUND OF THE INVENTION

1. Field of the Invention

The present invention relates to a game of chance and skill, and in particular, to such a game which utilizes playing pieces of different values arranged in a single hand with one wild card and one opportunity to draw, where the object is to outrank the hand of a banker.

2. Description of Related Art and Other Considerations

A traditional Korean deck of playing cards includes 20 cards with yellow designs thereon, each of which bears a number. There are two cards which bear the number 10, two which bear the number 9, and so on through two cards which bear the number 1. The cards all have different designs on them so that no two cards have the same design even though they bear the same numbers. Two cards bear special markings which, when taken together, cause them to be designated as the "Golden Pair". It is the markings, and not the numbers, on these cards which cause them to be identified as the "Golden Pair". For example, the "Golden Pair" may bear the numbers "8" and "3". The "Golden Pair" is the highest ranking hand. This traditional deck of cards includes only cards with yellow designs on them. This traditional Korean game provides for the determination of winners first by the "Golden Pair", or, failing that, by numbers, with pairs being higher ranking than other number combinations. Next down in the hierarchy from the "Golden Pair" is the yellow 10s pair, followed by the yellow 9s pair, on down to the yellow 1s pair. Except for the "Golden Pair", yellow cards are determined to be pairs by the numbers that they bear, and not by their designs. Below the yellow pairs is a hierarchy of number combinations running from 9 down to 0. A ten is counted as a zero. Each player is dealt two cards in confidence. After the cards are dealt the wagering begins. No banker is involved so each player plays against all of the others in the game. There is no opportunity to receive another card. The possible combinations, and the challenge of playing the game, are, therefore, limited.

SUMMARY OF THE INVENTION

These and other problems are successfully addressed and overcome by the present invention wherein at least two, and up to eight or more, players initially receive equal numbers of playing pieces in confidence from a dealer, which playing pieces comprise the hands of the respective players. According to a preferred embodiment of the invention, the traditional Korean deck of 20 yellow design cards is used but it is augmented with 14 additional cards of a different color, for example, blue. The game which is played with this modified deck of 34 cards, according to the present invention, is identified herein and in the claims appended hereto as "Lucky Moon". In order to make it possible for the players to have the option of being dealt an additional card, and to increase the speed of play, the game is played from a shoe containing up to a dozen or more, for example, 13, of the modified 34 card decks. The highest ranking hand, unlike the traditional Korean game, is one which contains a specially marked card, for example, the yellow 8. Special rules are provided which govern the inclusion of the 14 extra cards, and the valuation of a hand which includes the one specially marked card.

One of the players is designated a banker. The other players play against the banker/player. Generally, wagers are placed, and the banker/player indicates the total amount which he is willing to risk, before the playing pieces are dealt. The action player, that is, the player who will play first against the banker, is preferably selected for each round of play by some suitable random method such as, for example, throwing dice. Sets of randomly selected playing pieces are dealt to all of the players in confidence. Each player in turn indicates whether that player wishes to receive (draw) an additional playing piece, and receives such a playing piece, if desired. The dealer then exposes the banker/player's playing pieces.

The respective hands or sets of the players are compared, each in turn, to the hand of the banker. Play is concluded between the first player and the banker/player before play between the banker and the second player is commenced. The outcome may be a tie (push) in which no winner is declared. If the outcome is not a tie, then either the banker or the player wins.

Preferably, there are from two to eight players, one of whom is designated the banker/player against whom the other players play, and a separate dealer who administers the game. Preferably, the dealer is not a player. Preferably, each player initially receives two playing pieces, with the option of drawing one more.

The banker designation preferably rotates among all of the players according to some predetermined order, for example, the banker designation may rotate clockwise after every second round of play. Each player has the option of declining to be the banker. The position of dealer preferably does not rotate. The game, according to a preferred embodiment is suitable for casino play, where the dealer is a representative of the house who administers the play of the game. The banker may or may not be a representative of the house.

According to the present invention, for the play of "Lucky Moon" a series of 14 blue cards in seven numeric pairs is added in the hierarchy of values between the yellow 1s pair and the number combinations of the above described traditional Korean game. The deck thus consists of 34 cards. This considerably expands the challenge and excitement of playing the game. The "Golden Pair" is the highest ranking hand. As between blue and yellow, yellow cards in pairs are the highest ranking. The numeric values of the blue cards range from 7 to 1. Pairs can not be made up from different colored cards. The combination, for example, of a yellow 7 and a blue 7 does not make a pair. Such a combination is valued as a numeric combination. A yellow pair prevails over a blue pair of any numeric value. Thus, the yellow pair, 1-1, prevails over the blue pair, 7-7. Pairs prevail over other number combinations. Thus, the blue pair 1-1, prevails over a hand consisting of yellow 5 and yellow 4. Number combinations, other than pairs, can be made up of different colored cards. A hand consisting of a yellow 4 and a blue 5, for example, is ranked as a 9. A hand consisting of a blue 2 and a yellow 10 is ranked as a 2 because the 10 is counted as 0. The highest number combination permitted is 9. When a number combination goes over 9 the first digit is disregarded and the hand is valued at the value of the second digit. Thus, a numeric combination hand consisting of 5-6 is valued at 1, a hand of 9-8 is valued at 7, and a hand of 7-8 is valued at 5. A hand, for example, containing a blue 2 and a yellow 2 is valued as 4, however, a hand containing a blue 7 and a yellow 7 is also valued as a 4. One specially marked card, to which special significance is assigned, is treated as a wild card. The golden 8 may, for example, be designated as the wild card. Thus, the holder of the specially marked card will automatically have a pair of whatever the other card in the hand is.

As will be understood by those skilled in the art, other ranking systems may be employed, for example, the yellow cards could be assigned more significance that the blue cards in number combinations so that a hand with a yellow 5 and a yellow 4 would outrank a hand with a blue 5 and a blue 4, and the like. Other systems with established ranking methods which are well known to those skilled in the art can also be employed, if desired.

The opportunity to draw an additional playing piece, and the desire for a fast paced game with up to 8 or more players dictate that the game should be played out of a shoe with a plurality of the 34 piece playing sets randomly distributed in the shoe.

Other aims and advantages, as well as a more complete understanding of the present invention, will appear from the following explanation of exemplary embodiments and the accompanying drawings thereof.

DETAILED DESCRIPTION OF THE PREFERRED EMBODIMENTS

Figure 1:
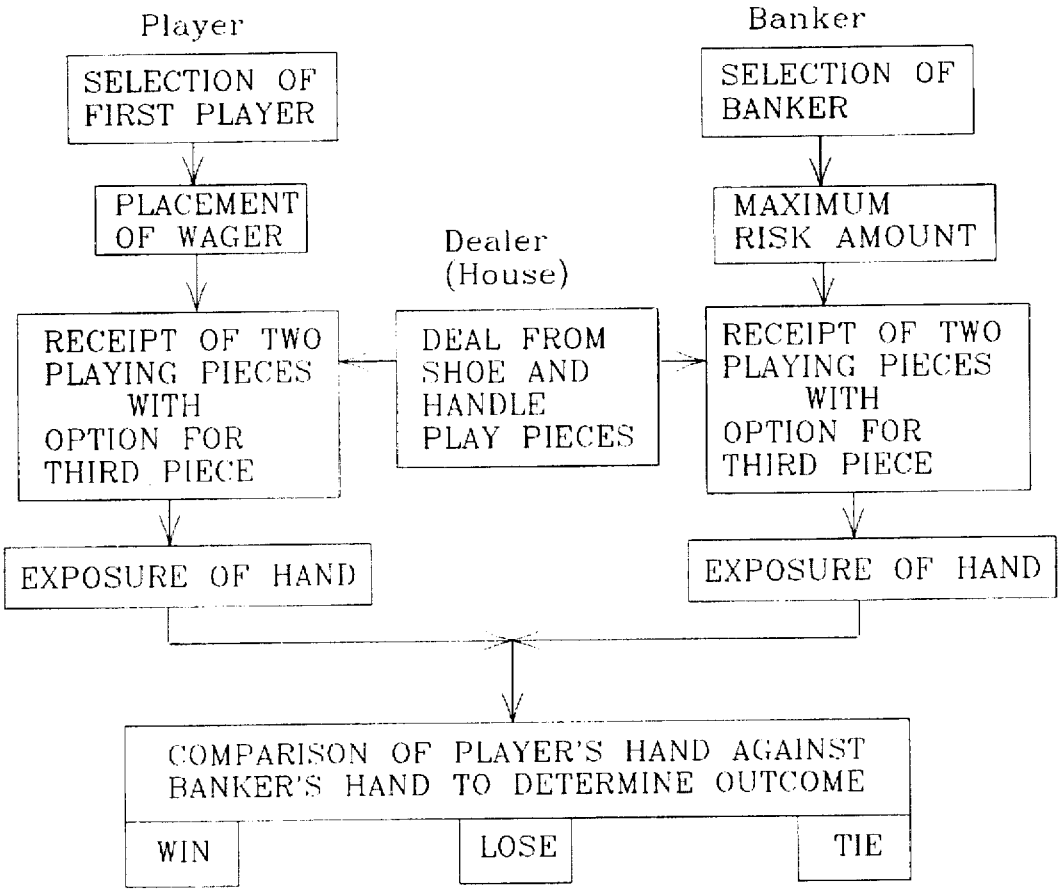
FIG. 1 is diagram which shows a preferred sequence for one round in the play of a game according to the present invention.

Referring particularly to the drawings for purposes of illustration and not limitation, there is illustrated in FIG. 1 a typical sequence of play for a game of Lucky Moon in which there is an independent dealer, a banker and a player. Where a particular round of play involves two or more players, all of the players go through the steps illustrated in FIG. 1 down to the step where the first (action) player's playing pieces are compared with those of the banker/player. The comparison step is carried out in turn for each player beginning with the action (first) player. The comparison step for the first player against the banker/player is carried out to the final outcome of play for first player before the next player's hand is considered. A round of play ends when all of the players have had a chance to play against the banker/player, or the banker/player loses all of the "Maximum Risk Amount", whichever comes first. If the banker/player loses all of the amount which he was willing to risk ("Maximum Risk Amount") before a player gets to play against the banker/player, that player simply keeps what he wagered. The sequence of the selection of the banker/player and the first or action player, and the placement of wagers and declaration of maximum risk amount, may be inverted, if desired.

All of the playing pieces which comprise the full set of pieces furnished to the banker/player or a player may be furnished one piece at a time in rotation, or all of one set of playing pieces may be dealt to a player at one time. Preferably, each player is dealt one piece in turn before any player receives a second piece. In general, the playing pieces are preferably cards, although, as will be understood by those skilled in the art, other playing pieces may be used, if desired.

Preferably, each player is permitted to handle that player's playing pieces in confidence, and to receive a third playing piece in confidence. The banker's hand is preferably treated somewhat differently. Preferably, the banker/player does not touch the playing pieces at all. The dealer exposes the banker's set of playing pieces and the banker verbally directs the dealer to provide a third playing piece to the banker, if desired.

When a player requests and receives a third playing piece, it is then impossible for that hand to be treated as containing a pair, even if, by reason of the third card, a pair is present. Hands with three cards are treated as numeric combinations, valued below the lowest blue pair, 1-1. A player holding the hand, blue 1-1, would never wish to receive a third card because it would always reduce the value of the hand. Thus, two hands which contain, for example, 1-4-3, of any color, and, 2-2-4, of any color, are both valued at 8. Two hands which contain, for example, 8-8-7, of any color, and, 10-1-2, of any color, are both valued at 3. If the wild card is in a hand which includes only 2 playing pieces, a pair of the non-wild playing pieces is automatically present. A player would never wish to draw an extra playing piece when holding the wild playing piece because it would reduce the player's hand from a pair to a number combination. Even if the player draws the wild playing piece, that player will still only have a numeric combination. For example, if the hand is wild card-blue 7, it is valued as if it were blue 7-blue 7. A yellow 10-wild card hand is valued as if it were yellow 10-yellow 10. In a hand which includes 3 playing pieces the wild playing piece does not create a pair. Thus, hands consisting of 3-wild card-1, or 2-wild card-1, or 10-wild card-1 would all be valued as a 9.

Figure 2:
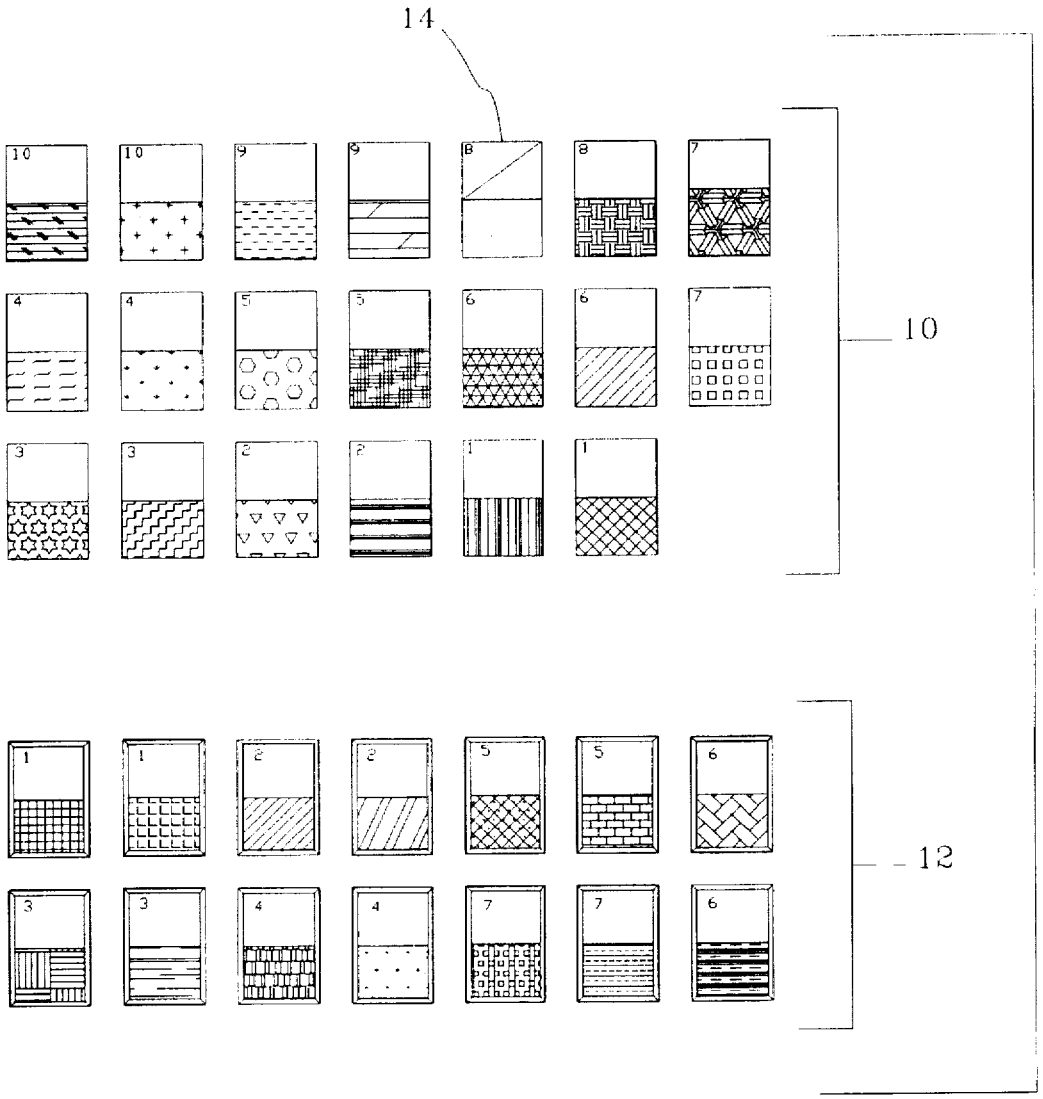
FIG. 2 illustrates the faces of 34 playing cards which comprise a full deck according to the present invention.

A full deck of 34 playing cards is illustrated in FIG. 2. The cards of a first color are illustrated at 10, and those of a second color are illustrated at 12. The wild card is illustrated at 14.

The present invention may, if desired, be played as a computer game with one or more of the dealer, banker/player, or players being simulated by a computer program, and the playing pieces being electronic artifacts presented on a monitor. The hardware and programing necessary to implement the computerization of this game are within the skill of the computer arts.

As will be understood by those skilled in the art, alternative, supplemental or additional steps and methods may be utilized within the scope of the invention. Although, as required, the invention has been described with respect to particular embodiments thereof, it should be realized that various changes and modifications may be made therein without departing from the spirit and scope of the invention.

What is claimed is:

1. A method of playing a game of chance by a dealer, a player/banker and at least one other player, comprising the steps of:

utilizing a plurality of decks randomly combined into one shoe, said decks comprising 34 playing cards each including 10 numeric pairs of a first color having individual designs and face values within the range of 10-10 to 1-1, and 7 numeric pairs of a second color having individual designs and face values within the range of 7-7 to 1-1, one of said cards being designated as a wild card, which, in combination, are capable of establishing an order of prevalence that enables a selection of one set of the playing cards to win over another selection of another set of the playing cards;

furnishing a first randomly selected set of the playing cards to a player;

furnishing a second randomly selected set of the playing cards to a player/banker;

furnishing an additional card to each of said player and said player/banker if requested;

comparing the first randomly selected set of playing cards to the second randomly selected set of playing cards, using predetermined rules of prevalence, to determine a winner or a tie therebetween, said predetermined rules comprising that the highest ranking hand is a pair of 10s of said first color, followed by numeric pairs from 9s to 1s of said first color, numeric pairs from 7s to 1s of said second color, and numeric combinations of any color with a maximum value of 9, with any hand containing 3 cards having a value of no greater than 9;

declaring the game a tie if the values of the first and second randomly selected set of cards are identical; and otherwise, declaring the highest valued of the first and second randomly selected sets to be the winner.

2. A method according to claim 1 including furnishing said randomly selected sets one playing card at a time in rotation, whereby all players receive a first playing card before any player receives a second playing card.

3. A method according to claim 1 including furnishing said randomly selected sets more than one playing card at a time, whereby the first player receives more than one playing card before the second player receives any playing cards.

4. A method according to claim 1, requiring a minimum of four persons, further comprising the steps of:

naming one of the persons as the provider of said furnishing steps, and the remaining persons as players;

selecting a remaining person as the player/banker; and randomly selecting a first of the remaining persons as the first player.

5. A method according to claim 1 including furnishing a third randomly selected set of playing pieces to a third player.

6. A method according to claim 1 including furnishing a plurality of randomly selected sets of the playing pieces to a plurality of other players.

7. A method according to claim 1 including using predetermined rules of prevalence wherein one card of said first color is a wild card.

* * * * *